US007426810B2

(12) United States Patent
Takahashi et al.

(10) Patent No.: US 7,426,810 B2
(45) Date of Patent: Sep. 23, 2008

(54) METHOD AND APPARATUS FOR PRODUCING POCKET COIL BAG ROW

(75) Inventors: Hiroyuki Takahashi, Takada-gun (JP); Yuuji Kameda, Takada-gun (JP)

(73) Assignee: Dreambed Co., Ltd., Hiroshima (JP)

( * ) Notice: Subject to any disclaimer, the term of this patent is extended or adjusted under 35 U.S.C. 154(b) by 202 days.

(21) Appl. No.: 10/577,234

(22) PCT Filed: Nov. 8, 2004

(86) PCT No.: PCT/JP2004/016903

§ 371 (c)(1),
(2), (4) Date: Apr. 26, 2006

(87) PCT Pub. No.: WO2005/044055

PCT Pub. Date: May 19, 2005

(65) Prior Publication Data

US 2007/0130883 A1 Jun. 14, 2007

(30) Foreign Application Priority Data

Nov. 7, 2003 (JP) ..... 2003-378512

(51) Int. Cl.
*B68G 9/00* (2006.01)

(52) U.S. Cl. ..... 53/114; 53/529; 53/528

(58) Field of Classification Search ..... 53/114, 53/529, 528, 527, 526, 115
See application file for complete search history.

(56) References Cited

U.S. PATENT DOCUMENTS

| | | | | |
|---|---|---|---|---|
| 3,492,783 | A * | 2/1970 | Dohmeier | 53/562 |
| 3,668,816 | A * | 6/1972 | Thompson | 53/418 |
| 4,439,977 | A * | 4/1984 | Stumpf | 53/428 |
| 4,578,834 | A * | 4/1986 | Stumpf | 5/720 |
| 5,987,678 | A | 11/1999 | Ayers | |
| 6,049,959 | A * | 4/2000 | Grondahl | 29/91.1 |
| 6,170,807 | B1 | 1/2001 | Eto | |
| 6,467,239 | B2 * | 10/2002 | Mossbeck et al. | 53/430 |
| 6,499,275 | B1 * | 12/2002 | Graf et al. | 53/436 |
| 6,684,608 | B2 * | 2/2004 | Gibbons | 53/436 |
| 6,834,477 | B2 * | 12/2004 | De Santis et al. | 53/436 |

FOREIGN PATENT DOCUMENTS

| | | |
|---|---|---|
| JP | 10-509367 | 9/1998 |
| JP | 11-253278 | 9/1999 |
| JP | 2000-41792 | 2/2000 |
| JP | 2001-340175 | 12/2001 |

* cited by examiner

*Primary Examiner*—Sameh H. Tawfik
(74) *Attorney, Agent, or Firm*—Oliff & Berridge, PLC

(57) ABSTRACT

An apparatus for producing a pocket coil bag row has two or more coil spring producing apparatuses for producing springs having different wire diameters and has an apparatus for transporting coil springs from each coil spring producing apparatus to a coil chute section. The coil chute section has receiving chambers corresponding to coil springs having different diameters sent in from each coil spring producing apparatus, and opening/closing sections are provided in the lower portions of the receiving chambers. The coil chute section has one exit and has a control device for controlling opening/closing so that the opening/closing of the opening/closing sections is performed in accordance with a previously set arrangement pattern of the coil springs. The coil chute sends coil springs to the exit of the coil chute section in a preset order and individually seals the coil springs in continuous bags.

19 Claims, 14 Drawing Sheets

METHOD AND APPARATUS FOR PRODUCING POCKET COIL BAG ROW

TECHNICAL FIELD

The present invention relates to a method for producing a pocket coil bag row for a mattress, an apparatus for producing the pocket coil bag row and a pocket coil sheet.

BACKGROUND ART

It is desirable that a cushion that persons lay down thereon has characteristics best suited to each individual depending on height, weight, figure and posture during sleeping of the person. However, especially in the case of a spring mattress, to adapt cushion characteristics of any area on the mattress surface to each individual, production becomes difficult and takes too long time and therefore, under present circumstances, customization of the mattress has not been spread like customization of clothes.

This is because priority is given to the convenience for manufacturers of mass producing the same type of mattresses and improving the production efficiency and an apparatus and a method for producing a mattress for customization have not been considered so far.

Even if such an apparatus or a method was considered, under present circumstances, the production efficiency is poor. Any attempt for supporting the customization has not been made so far because of the following problems, for example: attempting to support customization by optionally combining two or more kinds of coils having different wire diameters requires at least two coiling machines, which leads to excessively high equipment expenses; while it is possible to manufacture the coils having different wire diameters using a single machine, this reduces productive efficiency because it takes long to adjust for switching the coiling machine, and increases the cost because manual labor for setting of a spring sheet as well as more space for the stock for each type of coils are required However, while people do not put on the same clothes every day, people spend on contacting the same bedclothes for at least several hours every day. In consideration of this, it is considered that customization of the mattress is a very important problem and that users' demand for the customization has increased.

For this reason, it has been devised that customization is achieved for almost the same production time of conventional mattresses by optionally combining coil springs having different elasticity to produce the spring sheet, controlling heat treatment time due to electrification for removing stress after coiling and forcibly applying external force after coiling to change winding pitch of the coils. Indeed, in an initial phase, such mattresses have an advantage that they exhibit elastic performances having different repulsive forces, but with use frequency and time passage, the elastic performances converge on a certain elastic performance and are changed to a uniform elasticity.

Furthermore, although it is considered that one coiling machine forms coil springs having different repulsive forces by coiling coil springs having the same wire diameter with the winding pitch of the coils being changed from the beginning, to increase repulsive force of the coil springs having the same wire diameter, it is necessary to make winding diameter of the coil spring smaller and make winding pitch larger without changing the number of windings. In this case, there results in unstable coil shape with a small winding diameter and a large coil length and due to a large angle of instability, weakening during use becomes larger, the coil spring is easy to break and there occurs a problem of durability. Thus, there is a limit to make discrimination in repulsive force and a large difference in repulsive force cannot be generated (Unexamined Patent Publication No. H11-253278 and Unexamined Patent Publication No. 2000-41792).

A problem to be solved is to address customization of a spring mattress as needs of the user by producing a spring sheet (pocket coil sheet) in units of rows corresponding to vertical rows or horizontal rows of the mattress and arranging coil springs having different wire diameters within the rows in a pattern.

DISCLOSURE OF THE INVENTION

A method for producing a pocket coil bag row 17 according to the present invention includes the steps of conveying and sending coil springs 2, 2' having different wire diameters, sent out from at least two or more coil spring producing apparatuses 1, 1' for respectively producing the coil springs 2, 2' having different wire diameters, into a coil chute section 3 having receiving chambers 4, 4' corresponding to the coil springs 2, 2' having different wire diameters at the side of an entrance 5, opening/closing sections 6, 6' in the lower portions of the respective receiving chambers 4, 4', and a single exit 7 for discharging the coil springs 2, 2' having different wire diameters; sending the coil springs having different wire diameters to the receiving chambers 4, 4'; controlling the opening/closing of the opening/closing sections 6, 6' so that the coil springs 2, 2' are arranged in a previously set pattern of the coil springs2, 2' having different wire diameters; sending out the coil springs 2, 2' to the exit of the coil chute section 3 in an order of the previously set pattern; and enclosing the coil springs 2 sequentially by a coil spring enclosing apparatus that forms continuous bags 9 and encloses the coil springs individually into the bags 9.

An apparatus for producing a pocket coil bag row 17 according to the present invention includes at least two or more coil spring producing apparatuses 1, 1' for respectively producing coil springs 2, 2' having different wire diameters, and an apparatus for conveying the coil springs 2, 2' having different wire diameters from the respective coil spring producing apparatuses 1, 1' to a coil chute section 3, wherein the coil chute section 3 includes a plurality of receiving chambers 4, 4 provided at an entrance 5 of the coil chute section, corresponding to the coil springs 2, 2' having different wire diameters sent from the respective coil spring producing apparatuses 1, 1', opening/closing sections 6, 6' provided in the lower portions of the receiving chambers 4, 4', and a single exit 7, a control device 8 is provided for controlling opening/closing of the opening/closing sections 6, 6' so that the coil springs 2, 2' are arranged in a previously set pattern of the coil springs 2, 2' having different wire diameters, and the coil springs 2, 2' are sent out to the exit 7 of the coil chute section 3 in an order of the previously set pattern, and enclosed individually into continuous bags 9 while forming the bags 9.

The apparatus for producing the pocket coil bag row 17 is provided with a feeding auxiliary apparatus, provided corresponding to each of the receiving chambers 4, 4, for sending the coil springs 2, 2' having different wire diameters when the opening/closing sections 6, 6' of the coil chute are open.

The apparatus for producing the pocket coil bag row 17 is provided with heat treatment apparatuses 12, 12' for heat treating the coil springs 2, 2' having electrodes provided at both sides of any area of the conveying apparatus 10, 10' for conveying the coil springs having different wire diameters to the coil chute section 3.

The apparatus for producing the pocket coil bag row 17 is provided with a metal sensor 14 for determining whether or not the coil springs 2, 2 having different wire diameters inserted into a folded cloth sheet 13 are inserted.

The apparatus for producing the pocket coil bag row 17 is provided with a marking apparatus for marking the cloth sheet to identify the type of the coil springs 2, 2' to be enclosed in the bag 9.

The apparatus for producing the pocket coil bag row 17 is provided with a feeding apparatus 16 for adjusting feeding speed of the cloth sheet 13 depending on the type of the coil springs 2, 2 inserted into the cloth sheet.

A pocket coil sheet is produced by the method for producing the pocket coil bag row 17 according to the present invention.

DESCRIPTION OF REFERENCE NUMERALS

Figure 1:
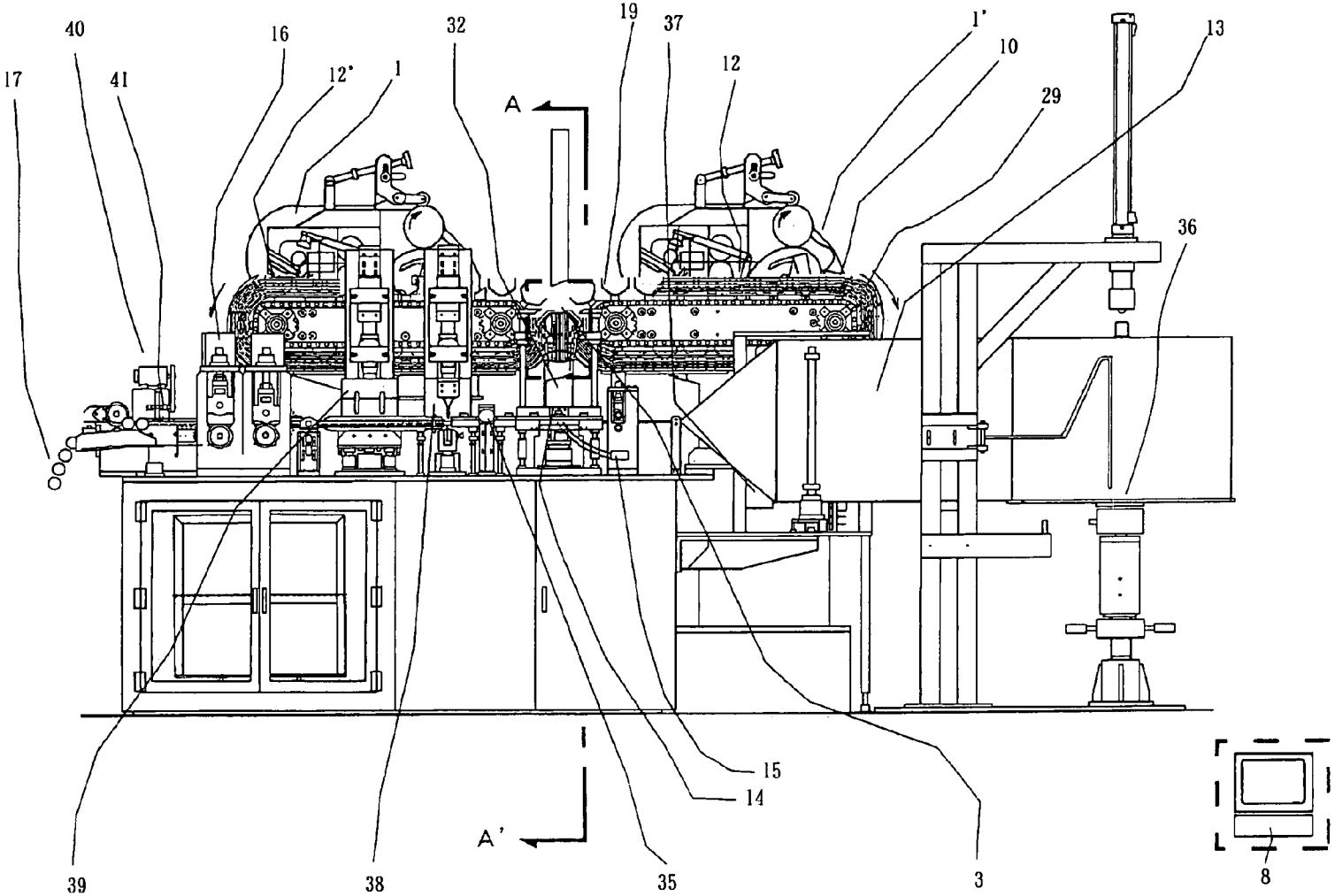
FIG. 1 is a partial cut-away sectional front view showing a pocket coil bag row according to the present invention.

1, 1' Coil spring producing apparatus
2 Coil spring having a thick wire diameter of 2.0 mm
2' Coil spring having a thin wire diameter of 1.9 mm
3 Coil chute section
4, 4' Receiving chamber
5 Entrance
6, 6' Opening/closing section
7 Exit
8 Control apparatus
9 Bag
10, 10' Conveying apparatus
11 Electrode
12, 12' Heat treatment apparatus
13 Cloth sheet
14 Metal sensor
15 Marking apparatus
16 Feeding apparatus
17 Pocket coil bag row
18 Pocket coil sheet
19, 19' Coil spring conveying case
20 Rodless cylinder
21 Coil pushing arm
22 Entrance frame
23 Intermediate frame
24 Exit frame
25 Rod
26, 26' Partition band
27, 27' Partition rod
28, 28' Coil pusher (feeding auxiliary apparatus)
29 Cover
30 Sandwiching cylinder
31 Lifting cylinder
32 Compressing apparatus
33 Coil pushing plate
34 Cylinder
35 Encoder
36 Cloth sheet rotational table
37 Cloth sheet folding section
38 Vertical welding apparatus
39 Horizontal welding apparatus
40 Coil raising apparatus
41 Propeller
42 Welded area

BEST MODE FOR CARRYING OUT THE INVENTION

Two coil spring producing apparatuses 1, 1' are provided, and in a preceding process for coil springs 2, 2' having different wire diameters in bags 9, opening/closing sections 6 are provided at the lower portions of entrances 5 of a coil chute section 3 having two of the entrances 5 and a single exit 7 and opening/closing of the opening/closing sections is controlled by a computer. With this, a pocket coil sheet in accordance with a pattern of any combination of the coil springs having different wire diameters can be produced for the same production time as that of the conventional pocket coil spring sheet consisting of coil springs having the same diameter.

FIG. 1 is a partial cutaway front view showing an embodiment of the present invention. Two coil spring producing apparatuses 1, 1' for producing a coil spring 2 having a thick wire diameter and a coil spring 2' having a thin wire diameter, respectively, are provided adjacent to each other, and the coiled coil spring 2, 2' fall into coil spring conveying cases 19, 19' . . . fixed on a belt conveyer 10 of conveying apparatus 10, 10' corresponding to the coil spring producing apparatuses 1, 1' at established intervals and are conveyed to a centrally located coil chute section 3.

Figure 2:
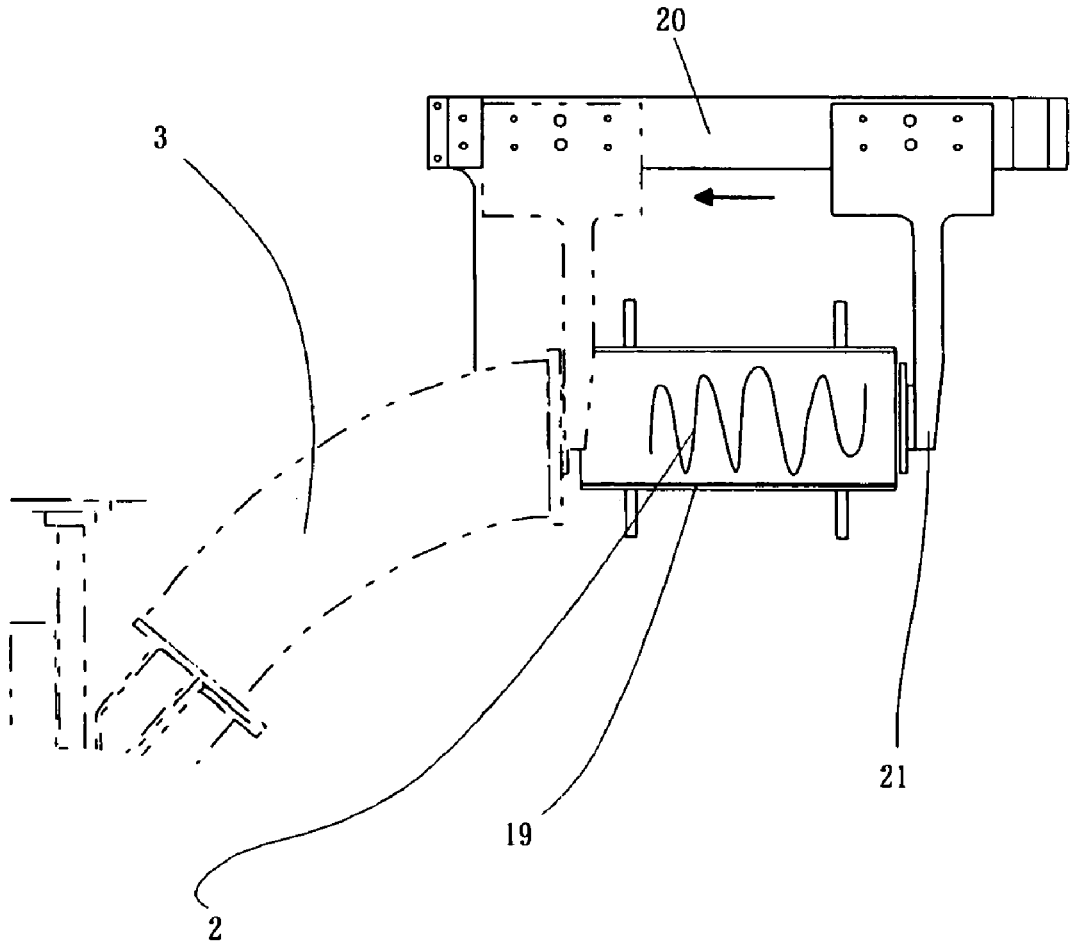
FIG. 2 is a partial side view of a part pushed into a coil chute section from a coil spring conveying case in FIG. 1.

The coil spring 2, 2' conveyed to the coil chute section 3, as shown in FIG. 2, are pushed into the coil chute section 3 by moving a coil pushing arm 21 coupled to a rodless cylinder 20 in the direction shown by an arrow due to driving of the rodless cylinder 20.

Figure 3:
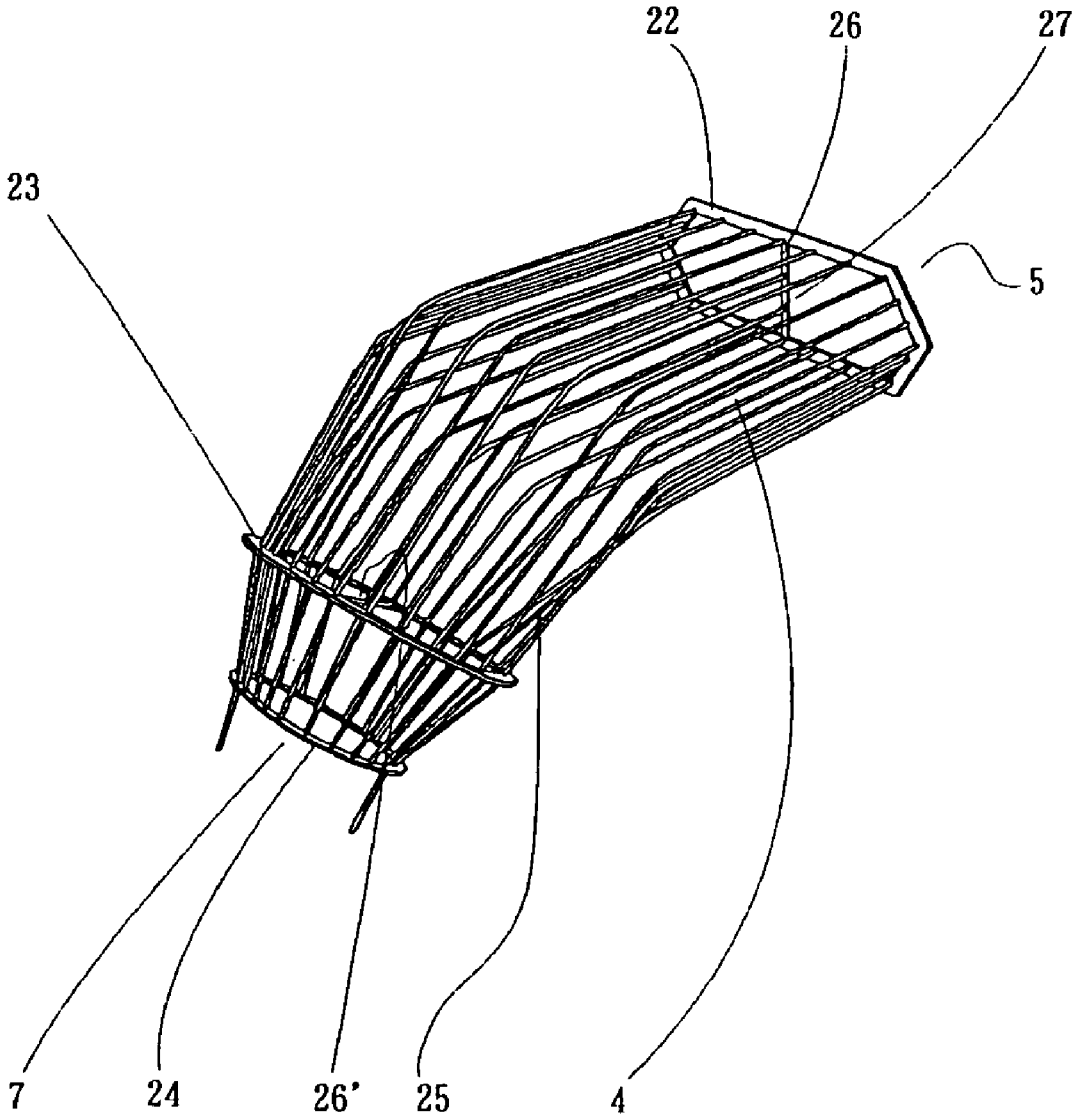
FIG. 3 is a perspective view showing a shape of the coil chute section in FIG. 1.
Figure 4:
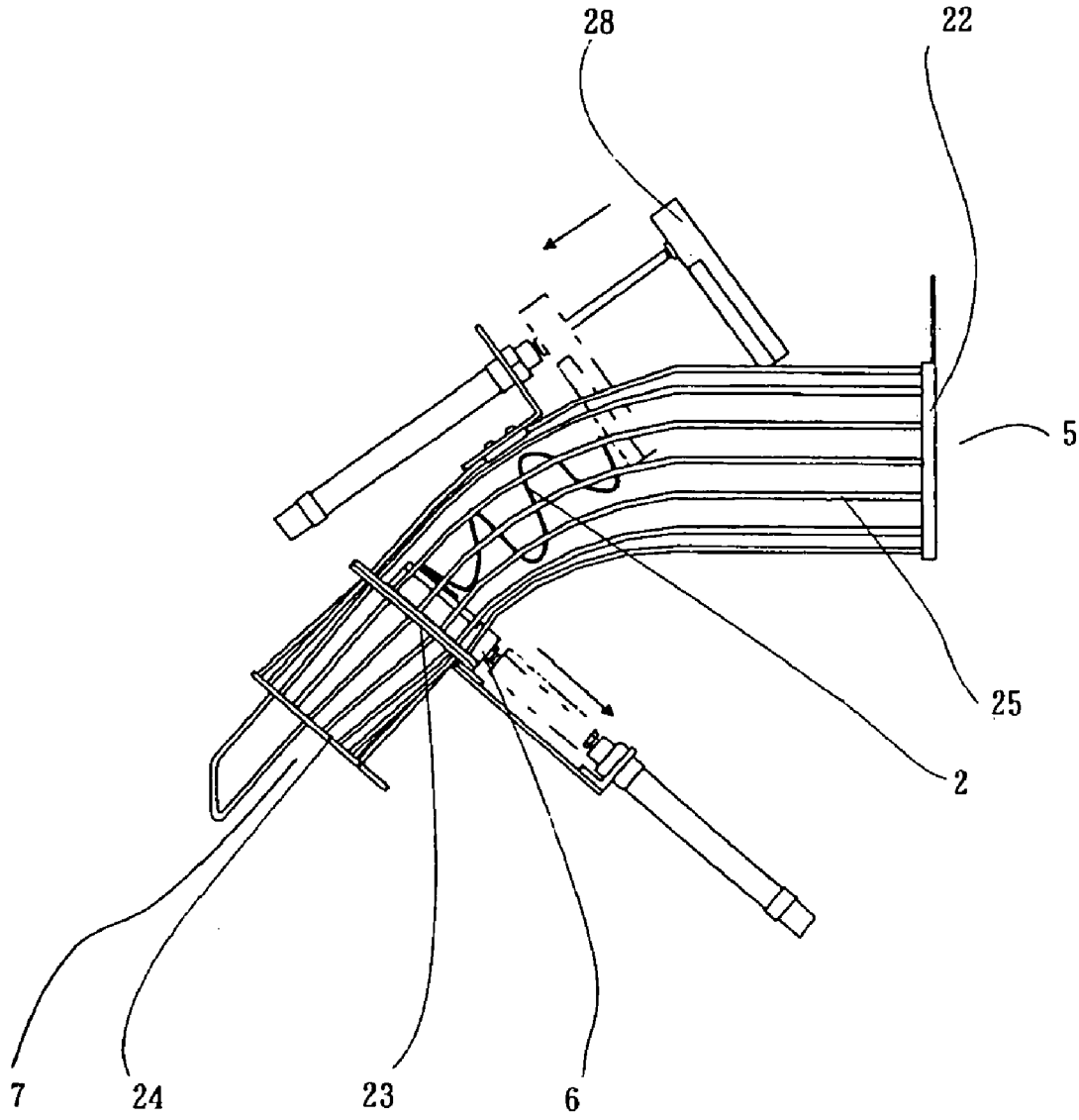
FIG. 4 is side view showing coil pushers and opening/closing sections in the coil chute section in FIG. 1.
Figure 5A:
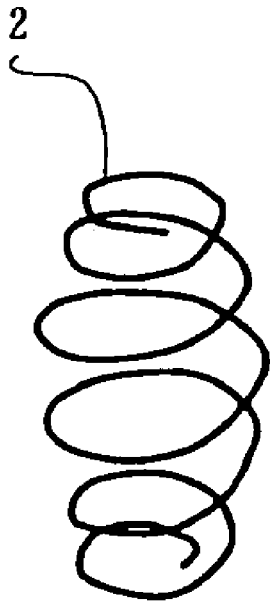
FIG. 5*a* is a perspective view showing a coil spring having a thick wire diameter and FIG. 5*b* is a perspective view showing a coil spring having a thin wire diameter.
Figure 5B:
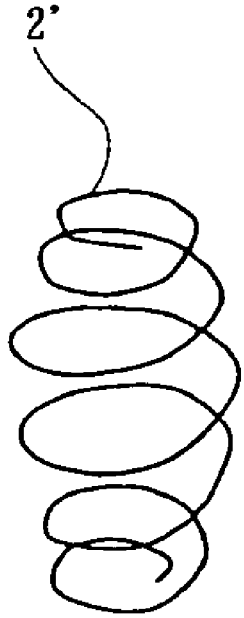

As shown in FIG. 3 and FIG. 4, the coil chute section 3 are formed in the shape of a basket as a whole by connecting peripheries of a hexagonal entrance frame 22, an intermediate frame 23 and an exit frame 24 to each other with a plurality of rods 25, and partition bands 26, 26' of the entrance frame 22 and the intermediate frame 23 are connected to each other with partition rods 27, 27' to divide the space between the entrance frame 22 and the intermediate frame 23 into two coil spring receiving chambers 4, 4' for separately receiving the coil spring 2 having a thick wire diameter and the coil spring 2' having a thin wire diameter therein.

Next, FIG. 4 is a side view of the coil chute section 3. Since the coil spring 2, 2' stored in the coil spring receiving chambers 4, 4' are hard to smoothly move downward by the falling due to their own weights, the coil spring 2, 2' are pushed by coil pushers (delivery auxiliary apparatuses) 28, 28' provided so as to correspond to the respective receiving chambers 4, 4' to move to opening/closing sections 6, 6 of the intermediate frame 23.

Two right and left opening/closing sections 6 are provided so as to correspond to the receiving chambers 4, 4', respectively, are opened/closed by extending and contracting cylinders and deliver the respective coil springs 2, 2' to an exit 7. The extension and contraction of the cylinders for opening/closing the right and left opening/closing sections 6 of the coil chute section 3 is set and controlled for each arrangement pattern by a computer, which enables automatic production with any arrangement pattern in a pocket coil sheet representing the whole of rows of coil springs forming a mattress.

Figure 6:
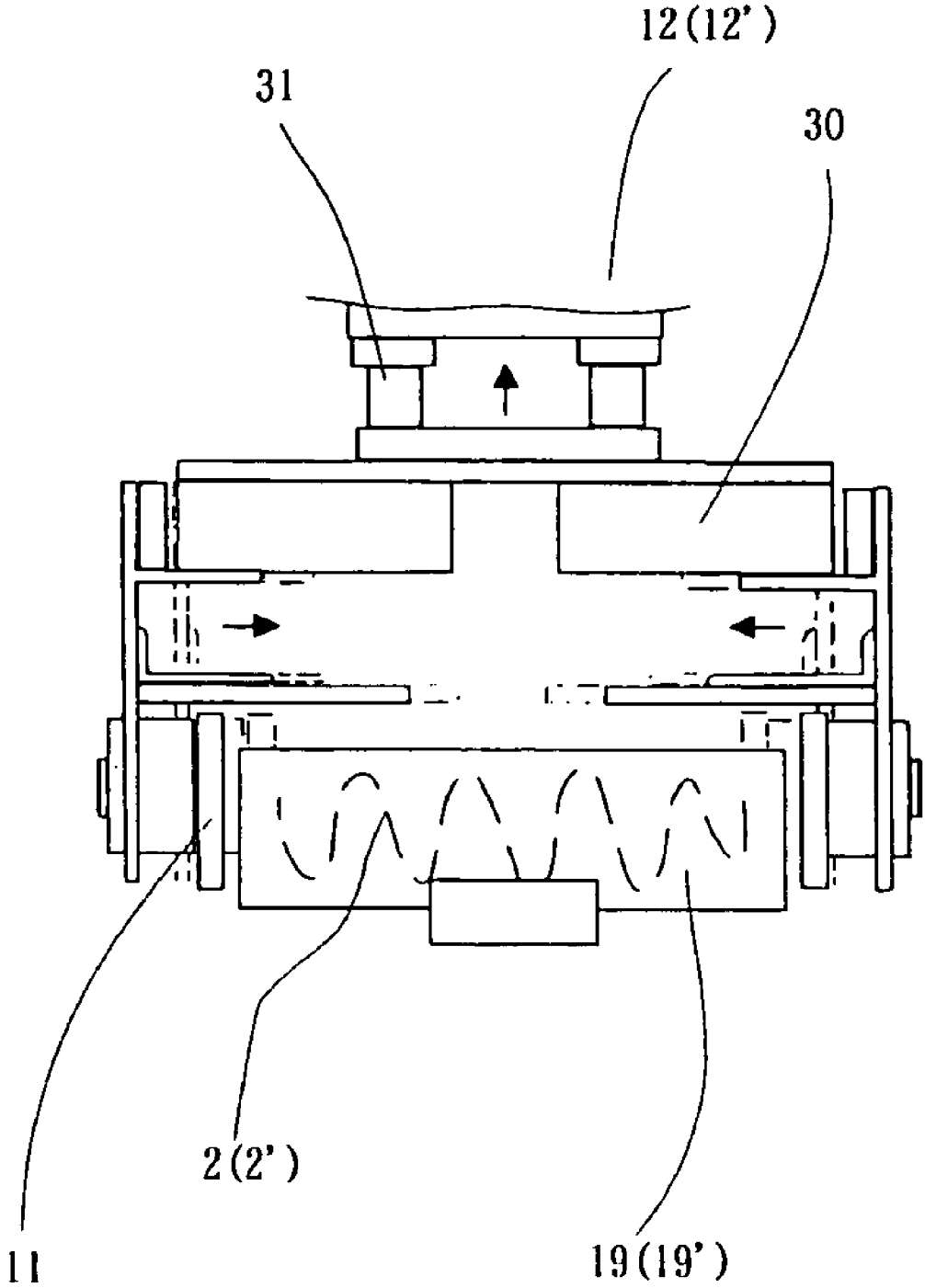
FIG. 6 is a side view showing a heat treatment apparatus shown in FIG. 1.

The conveying apparatus 10, 10' for the coil springs 2, 2' as shown in FIG. 1, employ an endless rotating conveyor system, the plurality of coil spring conveying cases 19, 19' are fixed on the conveyor at regular intervals and a lower face and both side faces of the coil spring 2, 2' are covered with a cover 29 so as not to fall from the coil spring conveying cases 19, 19'. As shown in FIG. 6, each of the heat treatment apparatuses 12, 12' is installed at arbitrary positions during conveyance and has electrodes 11 on each side. In the state where the coil spring 2, 2' each are sandwiched between the electrodes 11 by driving sandwiching cylinders 30 and the coil spring conveying cases 19, 19' each are lift up by driving lifting cylinders 31, a current of 350 A to 450 A is applied to the coil spring 2, 2' under low voltages for 0.1 seconds to 0.2 seconds. Low-temperature heat treatment for removing stress after coiling is performed in this manner and the coil spring 2, 2' are conveyed to the coil chute section 3. The reason why the coil spring 2, 2' are lift from the coil spring conveying cases 19, 19' during heat treatment is that a current is prevented from flowing to the coil spring conveying cases 19, 19' sides.

Figure 7:
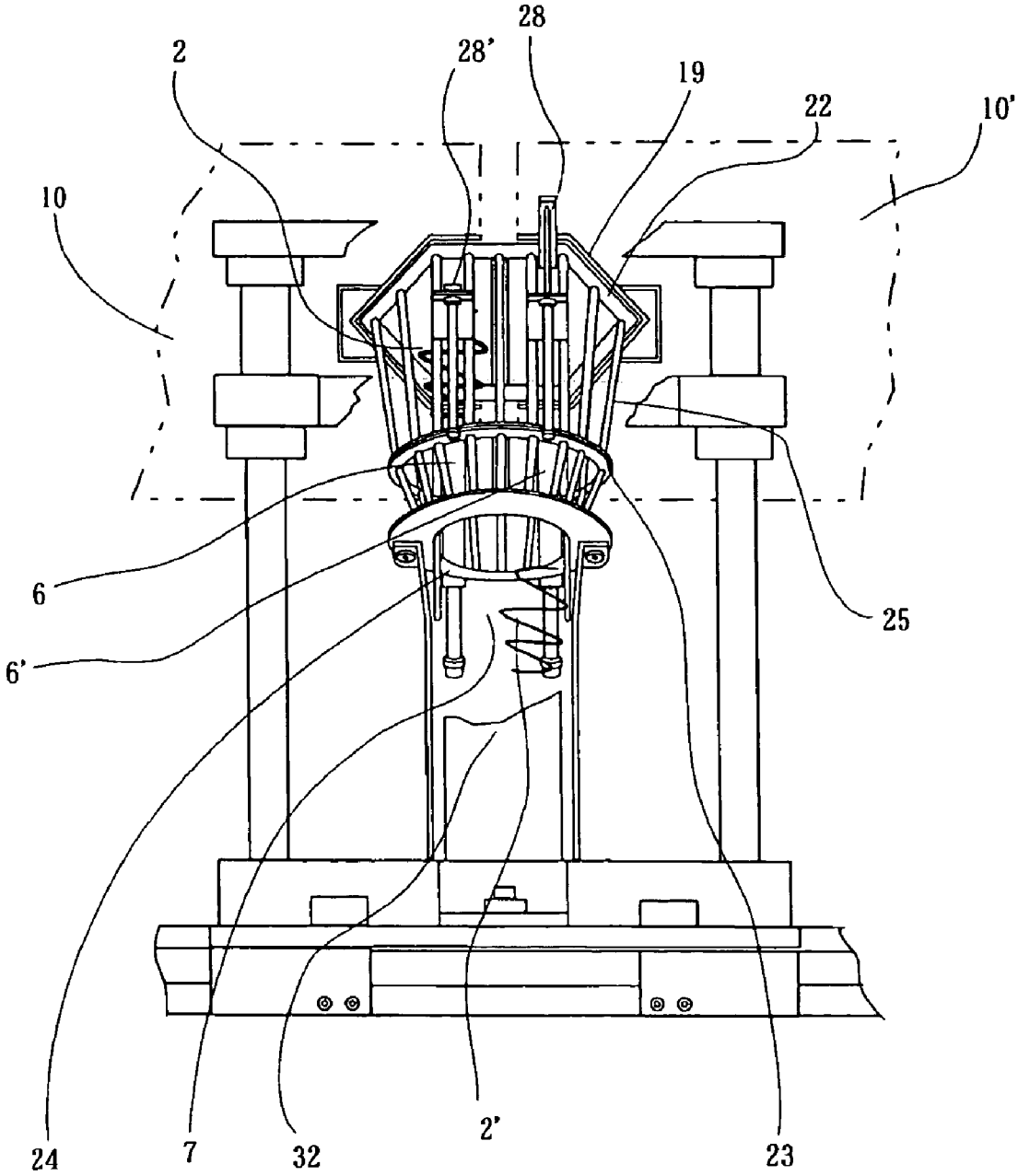
FIG. 7 is a enlarged view of the coil chute section shown in FIG. 1.
Figure 8:
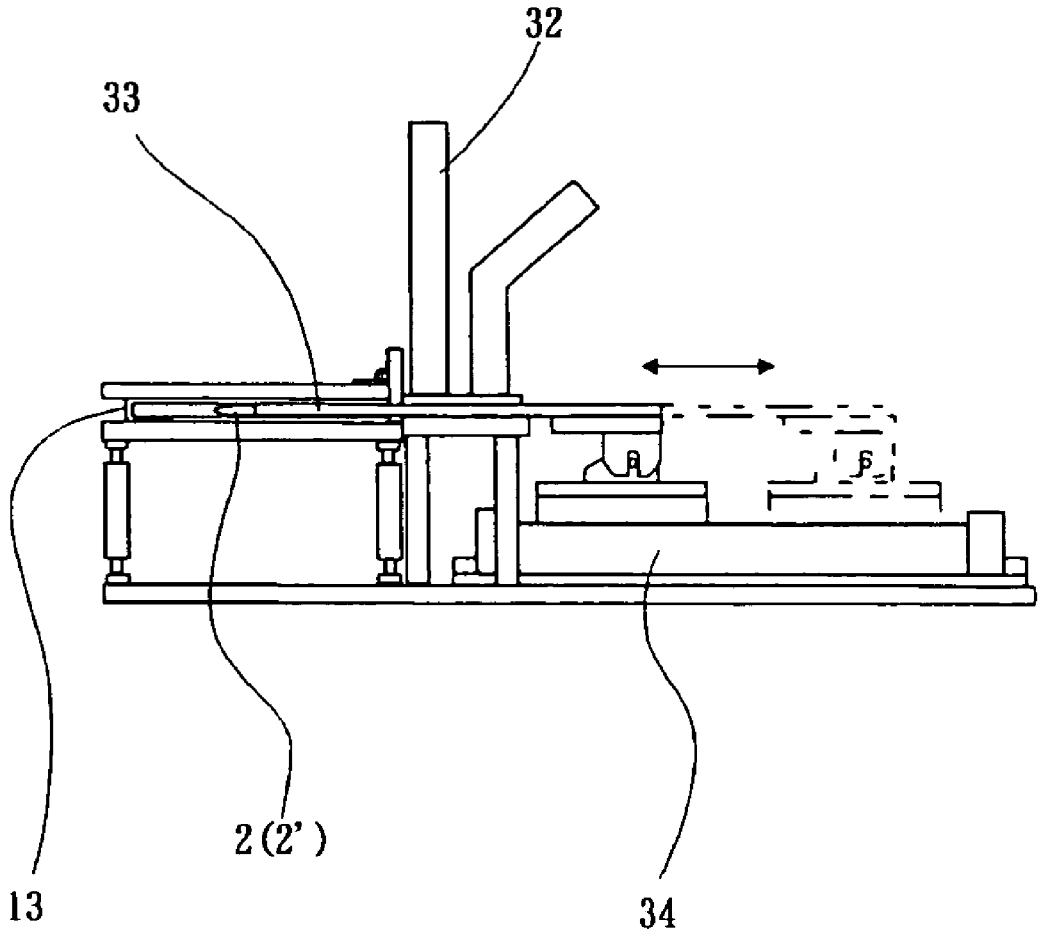
FIG. 8 is a partial sectional view of a state where the compressed coil spring shown in FIG. 1 is inserted into a cloth sheet taken along a line A-A'.

As shown in FIG. 7, an available one of the coil springs 2, 2' sent to the coil chute section 3 is discharged from the exit 7 according to the control of the opening/closing sections 6, 6' and enter into a compressing apparatus 32. As shown in FIG. 8, after compression, by moving coil pushing plate 33 due to the driving of a cylinder 34 coupled to the coil pushing plate 33, the available coil spring is inserted into a cloth sheet 13 from an opening side of the folded cloth sheet 13. Heat weldable nonwoven fabric is used as the cloth sheet 13.

Figure 9:
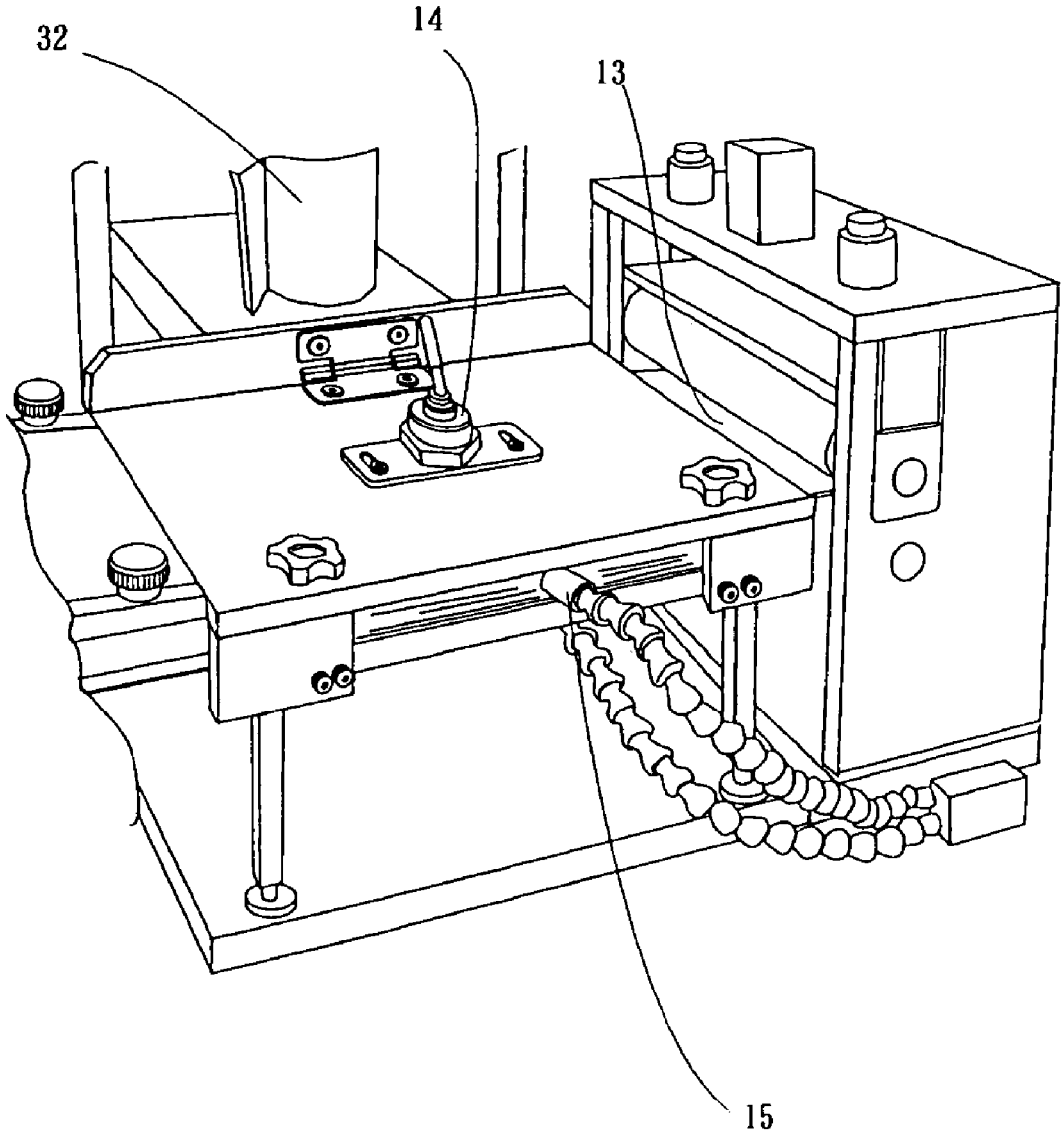
FIG. 9 is a partial perspective view showing a marking apparatus and a metal sensor in FIG. 1.

As shown in FIG. 9, a metal sensor 14 is disposed on the inserting section of the coil springs 2, 2' into the cloth sheet 13 to check whether or not the coil springs 2, 2' are inserted into the cloth sheet 13. When an omission of insertion occurs, the omission of insertion can be prevented by stopping the feeding of the cloth sheet 13 so that the coil spring 2, 2' may be inserted.

Since the coil spring 2, 2' having different wire diameters are inserted into the cloth sheet 13, when the coil springs 2, 2' having two kinds of wire diameters, that is, the coil spring 2 having a thick diameter of 2.0 mm and the coil spring 2' having a thin diameter of 1.9 mm, are inserted in a predetermined order, it is possible to determine which of the coil spring is inserted by spraying paint to the folded part of the folded cloth sheet 13 into which the coil spring 2 having the wire diameter of 2.0 mm with a marking apparatus 15 for marking. When the number of coils is changed by row according to the coil arrangement pattern, since the number of coils for each row is hard to be determined, another marking may be added to a certain number of rows of the cloth sheet 13.

Figure 10:
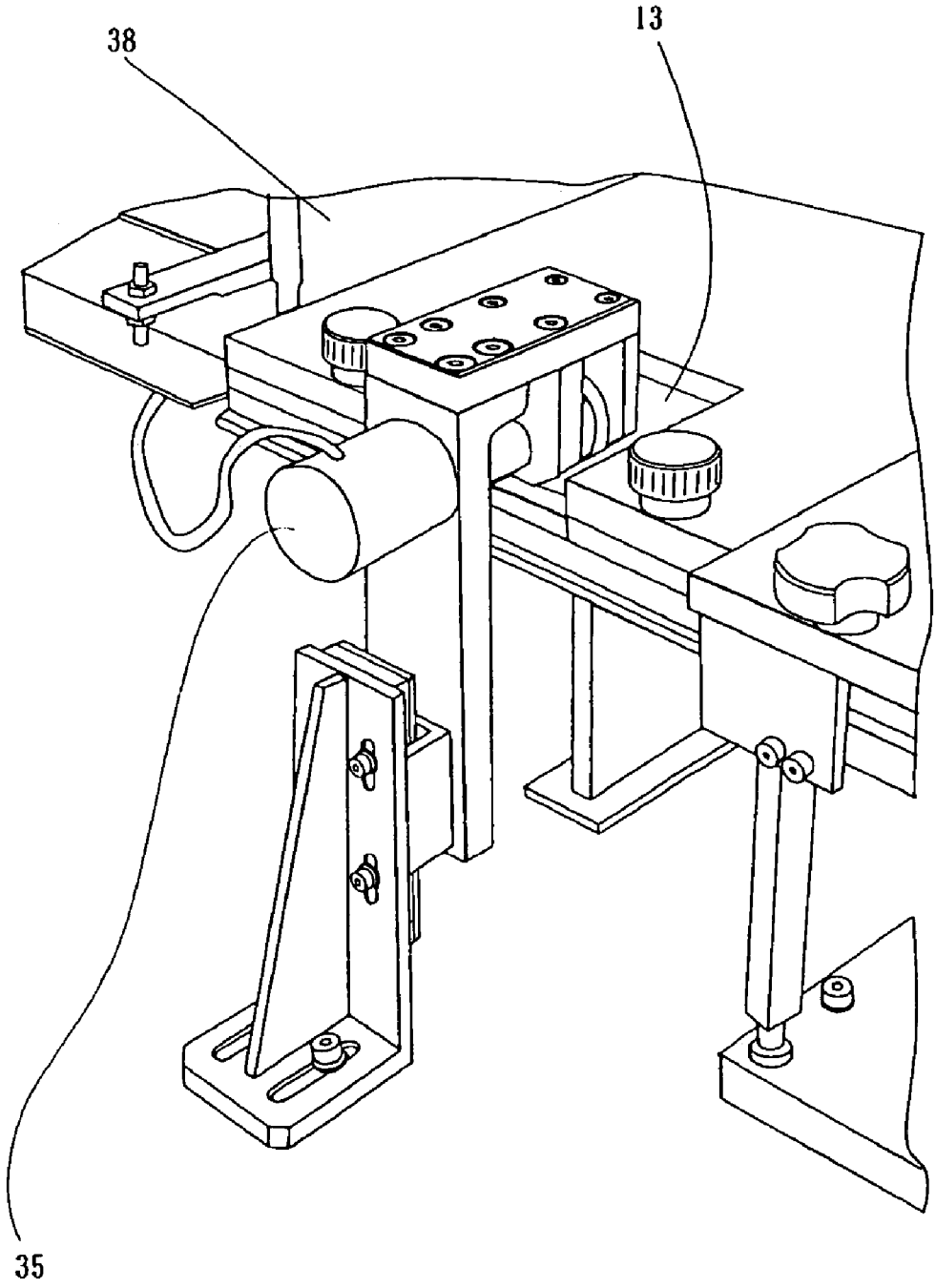
FIG. 10 is a partial perspective view showing an encoder shown in FIG. 1.
Figure 11:
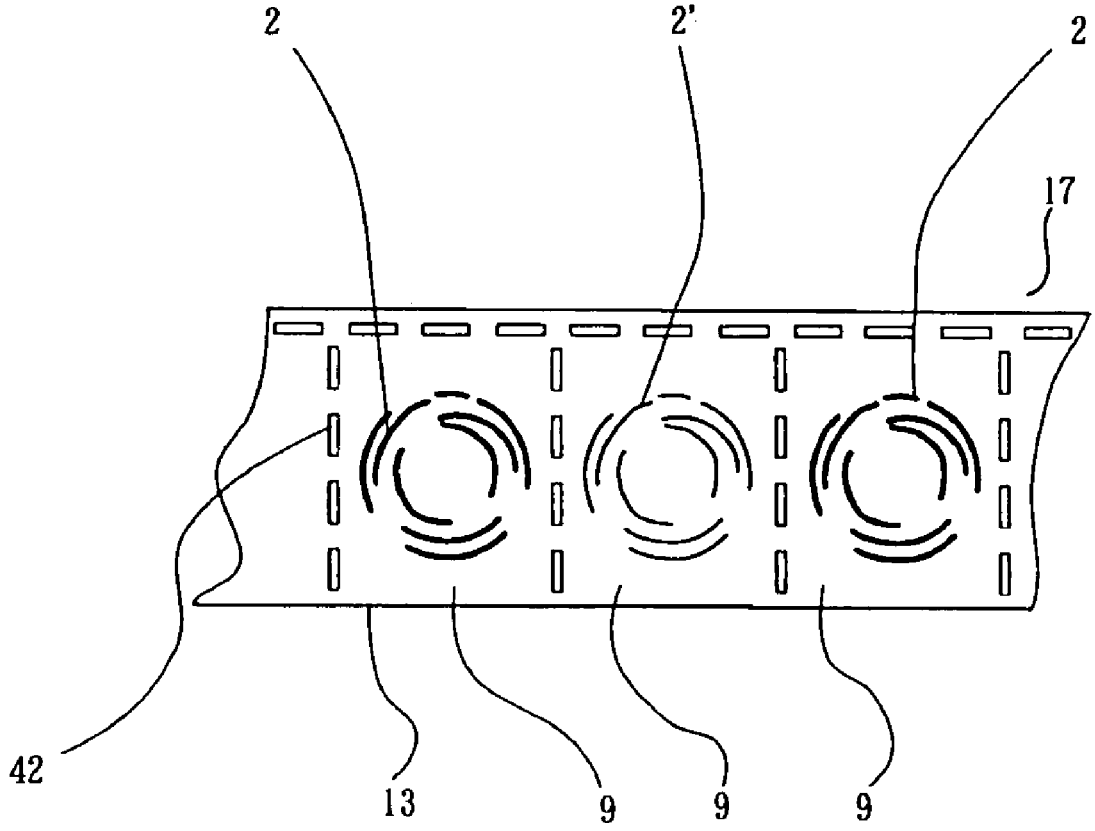
FIG. 11 is an explanation view showing a normal position of vertical welding to the cloth sheet in FIG. 1.

Since the repulsive force and frictional resistance of the coil spring 2, 2' inserted into the cloth sheet 13 in a compressed state is not constant due to a difference in wire diameters, when the cloth sheet 13 is sent at a constant feeding speed, a deviation occurs in a vertical welded area 42 for forming the cloth sheet 13 into the bags 9 and welding between coils at a normal position as shown in FIG. 11 cannot be achieved. Thus, there is provided a feeding apparatus 16 of the cloth sheet 13 for controlling so as to increase the number of rotations of a servo motor of the feeding apparatus 16 when the thick coil spring 2 having a high frictional resistance is inserted and to decrease the number of rotations of the servo motor of the feeding apparatus 16 when the thin coil spring 2' having a low frictional resistance is inserted and for making the feeding amount constant by measuring a feeding distance of the cloth sheet 13 by an encoder 35 (refer to FIG. 10) and feeding back the distance data to the feeding apparatus 16.

As shown in FIG. 1, the roll-like cloth sheet 13 held by a cloth sheet rotational table 36 is folded into two by a cloth sheet folding section 37. Following the insertion of the coil spring 2, 2', the vertical welded area 42 is heat-welded by a vertical welding apparatus 38 with high frequency and then a horizontal welded area is heat-welded by a horizontal welding apparatus 39 to form the bag 9 that encloses the coil spring 2, 2' therein, thereby forming a continuous bag row.

The continuous bag row that encloses the coil springs 2, 2' raises the coil spring 2, 2' in the compressed state after the passage through the cloth sheet feeding apparatus 16 by rotating a propeller 41 of the coil raising apparatus 40 and hitting the surface of the cloth sheet 13 to raise the coil spring 2, 2' that are inside in the compressed state, thereby completing a pocket coil bag row 17.

This pocket coil bag row 17 is formed based on the arrangement pattern of the coil springs having different wire diameters, which is preset in a control apparatus 8, in units of vertical rows or horizontal rows, the pocket coil bag row 17 are arranged and adjacent pocket coil bag rows 17, 17' are adhesively fixed to each other to form a pocket coil sheet 18.

According to a pocket coil producing apparatus, since the coil spring 2, 2' having different wire diameters can be enclosed in each bag 9 to form the pocket coil bag row 17, the pocket coil sheet 18 in which the coil spring 2, 2' having different hardness are arranged in any arrangement pattern can be automatically produced.

Figure 12:
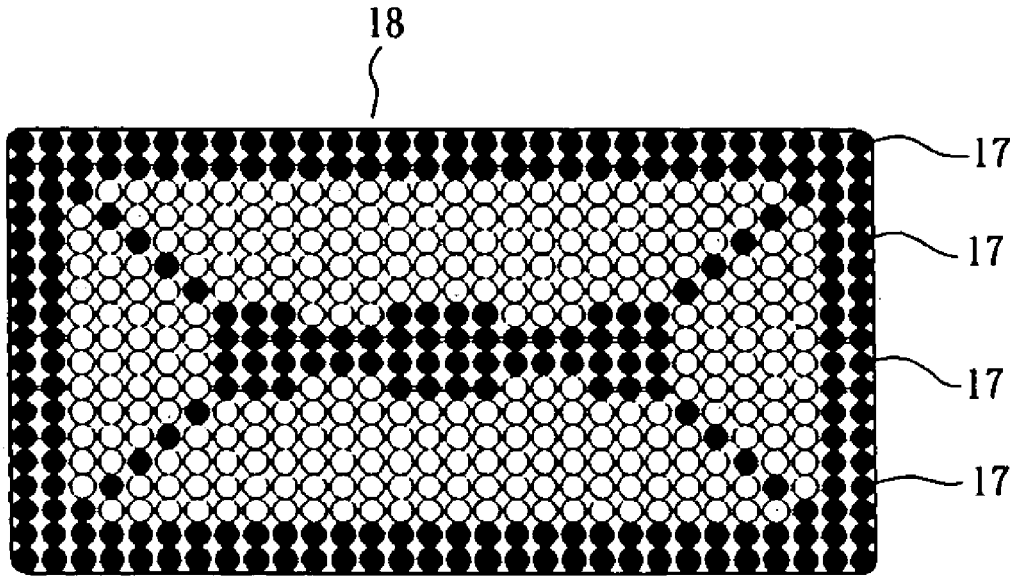
FIG. 12 is an explanation view of a pocket coil sheet.
Figure 13:
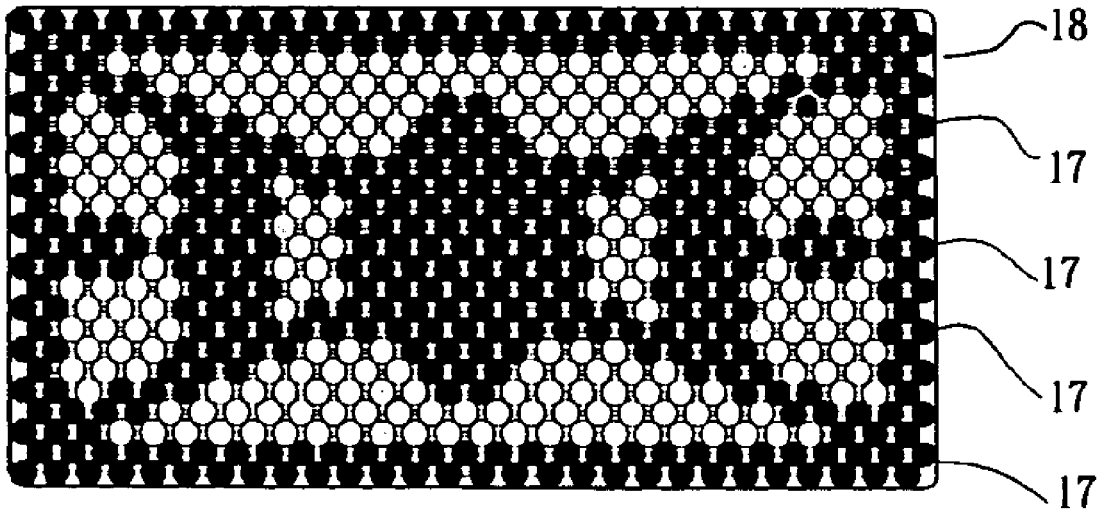
FIG. 13 is an explanation view of the pocket coil sheet.
Figure 14:
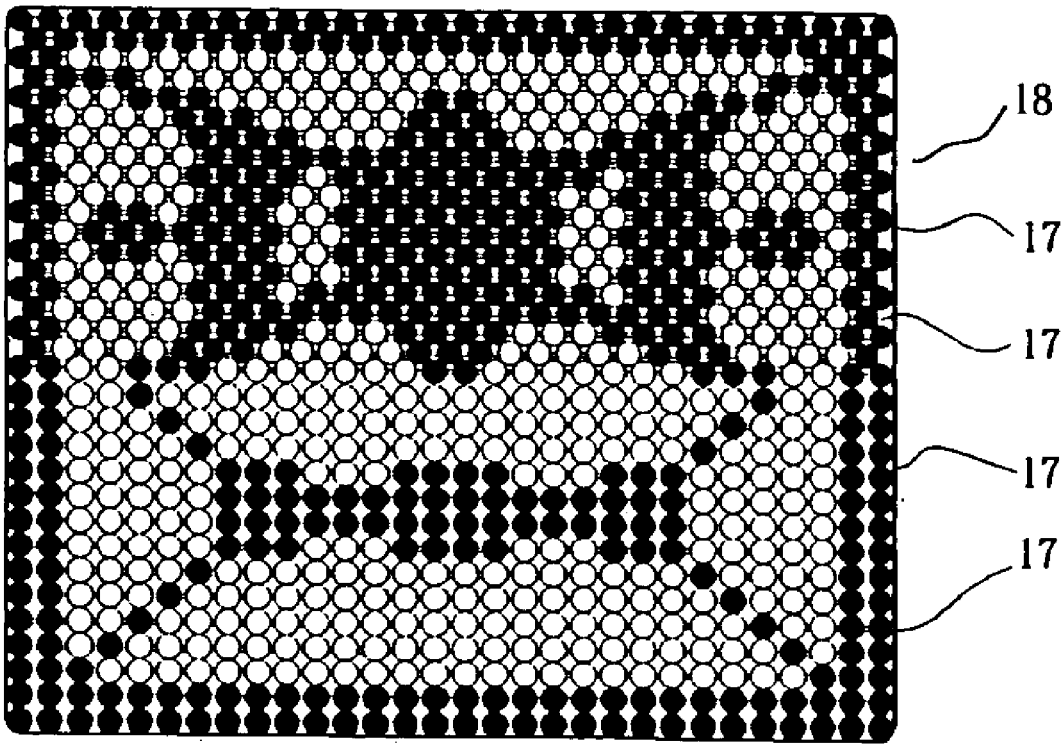
FIG. 14 is an explanation view of the pocket coil sheet.

FIG. 12 to FIG. 14 show examples of the arrangement pattern generated by the combination of 2.0 mm and 1.9 mm in wire diameter. In the figures, a black circle represents a coil spring having a wire diameter of 2.0 mm, a white circle represents a coil spring having a wire diameter of 1.9 mm and the horizontal direction represents the pocket coil bag row 17. FIG. 12 shows an example an arrangement pattern for a person having a height of 160 cm or less and a weight of 60 kg or less, in which the coil springs having a wire diameter of 2.0 mm are arranged on a peripheral area and a contact area when the person lays down and a smaller number of coil springs are arranged in parallel as a whole. FIG. 13 shows an example an arrangement pattern for a person having a height of 170 cm to 180 cm and a weight of 70 kg to 80 kg, in which the coil springs having a wire diameter of 2.0 mm are arranged on a peripheral area and a contact area when the person lays down and a larger number of coil springs are arranged in a staggered manner as a whole. FIG. 14 shows a pattern in the case where the two persons lay down together on a queen-size mattress, in which the coil springs are arranged in parallel and in a staggered manner with the number of coil springs being changed for each pocket coil bag row 17

As shown in FIG. 12 to FIG. 14, the pocket coil sheet 18 consisting of the same pocket coil bag rows 17 that enclose the coil springs 2, 2' having different wire diameters can be easily produced, it is possible to provide a cushion suited to various personal characteristics such as height, weight, figure and posture during sleeping.

Next, a method for producing the pocket coil bag row 17 will be described using the pocket coil sheet 18 in FIG. 13 as an example. First, by calling a file of the arrangement pattern in FIG. 13 that is previously stored in the control apparatus 8 or inputting the arrangement pattern of the coil spring 2, 2' and supporting start, a signal representing which of the two coil spring producing apparatuses 1, 1' for producing the coil springs having wire diameters of 1.9 mm and 2.0 mm, respectively, perform coiling is put out for each coil spring and a first, a second, . . . a twenty-eighth coil springs from the left end in a first row are sequentially coiled in this order.

In the arrangement pattern in FIG. 13, since all coil springs in the first row should be those having a wire diameter of 2.0 mm, the signal is continuously sent according to the control of the control apparatus 8 to the coil spring producing apparatus 1 on the 2.0 mm wire diameter side, the coil spring producing apparatus 1 is operated to coil the coil springs 2 having a wire diameter of 2.0 mm. Meanwhile, the coil spring producing apparatus 1' on the 1.9 mm wire diameter side is stopped waiting for the signal.

Next, moving to the second row, since the first and twenty-eighth coil springs in this row should be those having a wire diameter of 2.0 mm, similar to the first row, the signal is continuously sent to the coil spring producing apparatus 1 on the 2.0 mm wire diameter side according to the control of the control apparatus 8 and thus, the coil springs 2 having a wire diameter of 2.0 mm are coiled.

Going to the third row, from the first to third coil springs, a signal is sent to the coil spring producing apparatus 1 on the 2.0 mm wire diameter side according to the control of the control apparatus 8 and the coil springs 2 having a wire diameter of 2.0 mm are coiled. From the fourth to twenty-fifth coil springs, destination of the signal is switched to the coil spring producing apparatus 1' on the 1.9 mm wire diameter side according to the control of Meanwhile, the coil spring producing apparatus 1' on the 1.9 mm wire diameter side is stopped waiting for a signal. Subsequently, from the twenty-sixth coil spring, destination of the signal is switched to the coil spring producing apparatus 1 on the 2.0 mm wire diameter side and the twenty-sixth to twenty-eighth coil springs 2 having a wire diameter of 2.0 mm are coiled, while the coil spring producing apparatus 1' on the 1.9 mm wire diameter side stopped waiting for the signal. In the similar manner, based on the arrangement pattern of the pocket coil sheet 18 shown in FIG. 13, the control apparatus 8 switches destination of the signal and the coil springs 2, 2' having wire diameter of 2.0 mm and 1.9 mm, respectively, are sequentially coiled to the last twenty-third row.

The coiled coil springs 2, 2' . . . fall into the coil spring conveying cases 19, 19' of the conveying apparatus 10, 10' corresponding to the coil spring producing apparatuses 1, 1' and by the conveying apparatus 10, 10' that repeat the operation and suspension of conveyance in sync with the operation and suspension of the respective coil spring producing apparatuses 1, 1', are subjected to heat treatment in the heat treatment apparatuses 12, 12' and conveyed to an entrance 5 of the coil chute section 3.

The conveyed coil spring 2, 2' are discharged from the coil spring conveying cases 19, 19' by the coil pushing arm 21 and separately pushed to the 2.0 mm wire diameter side and the 1.9 mm wire diameter side of the receiving chambers 4, 4' on the left and right sides of the coil chute section 3.

The pushed coil spring 2, 2' are dropped to the opening/closing sections 6, 6' by the coil pushers 28, 28' and the dropped coil spring 2, 2' having wire diameters of 2.0 mm and 1.9 mm are put into the waiting state at the positions of the opening/closing sections 6, 6'. Based on the arrangement pattern of the coil spring 2, 2' corresponding to the pocket coil bag row 17 shown in FIG. 13, according to the control of the control apparatus 8, by switching destination of an opening/closing signal indicating which of the right and left opening/closing sections 6, 6' should be opened, the coil spring 2, 2' having wire diameters of 2.0 mm and 1.9 mm are sequentially sent to the single exit 7.

The sent coil spring 2, 2' are compressed by the compressing apparatus 32, are inserted into the folded cloth sheet 13 by the coil pushing plate 33, and, after going through the determination by the metal sensor 14 and the marking by the marking apparatus 15, sequentially sent by the feeding apparatus 16 of the cloth sheet 13 to the vertical welding apparatus 38 and then the horizontal welding apparatus 39 and individually enclosed to form a bag 9.

The pocket coil bag row 17 formed by individually enclosing the coil spring 2, 2' . . . in the continuous bags 9 is discharged from the feeding apparatus 16 of the cloth sheet 13 and in the final process, the coil springs 2 in the bags 9 are raised by the coil raising apparatus 40 to complete the pocket coil bag row 17.

According to the present invention, at least two coil spring producing apparatuses 1, 1' are provided, the coil chute section 3 has the plurality of receiving chambers 4, 4' corresponding to the coil springs 2, 2' having different wire diameters sent from each of the coil spring producing apparatuses at the entrance 5, the opening/closing sections 6, 6' are provided at the lower portions of the respective receiving chambers 4, 4', and the coil springs 2, 2' having different wire diameters in the receiving chambers 4 is sent to the exit 7 of the coil chute section 3 is determined by controlling the opening/closing of the opening/closing sections 6 through the computer. With such configuration, the coil spring sheet in any pattern of combination of the coil springs 2, 2' having different wire diameters can be automatically produced in the same production time as that of the conventional coil spring sheet, and since no problem occurs in durability even when a great difference between the repulsive force of the coil springs is made, it is possible to provide a customized spring mattress suited to height, weight, figure and posture during sleeping of each user.

Furthermore, since the coil spring producing apparatuses 1, 1' produce the coil springs 2, 2' having different wire diameters determined previously, initial cushion performances are not deteriorated so much as time advances and a spring mattress that can maintain cushion performances close to the initial performances after long-time use can be provided. Thus, the user can obtain comfortable feeling and good sleep.

INDUSTRIAL APPLICABILITY

Although the present invention is applied to the pocket coil sheet, the technique of automatically producing any arrangement pattern of the coil springs different wire diameters is not limited to the pocket coil sheet but can be applied to a spring sheet using bonnel springs or a spring sheet in which open coils are connected by helical springs.

The invention claimed is:

1. An apparatus for producing a pocket coil bag row comprising:

at least two or more coil spring producing apparatuses for respectively producing coil springs having different wire diameters; and an apparatus for conveying the coil springs having different wire diameters from the respective coil spring producing apparatuses to a coil chute section, wherein the coil chute section includes: a plurality of receiving chambers provided at an entrance of the coil chute section, corresponding to the coil springs having different wire diameters sent from respective coil spring producing apparatus, opening/closing sections provided in the lower portions of the receiving chambers, and a single exit, a control device is provided for controlling opening/closing of the opening/closing sections by selecting a destination of an opening/closing signal for deciding which opening/closing section is to be opened so that the coil springs are arranged in a previously set pattern of the coil springs having different wire diameters, the coil springs are sent out to the exit of the coil chute section in an order of the previously set pattern, and enclosed in the order of the previously set pattern individually into continuous bags while forming the bags.

2. An apparatus for producing a pocket coil bag row as stated in claim 1, further comprising:

a feeding auxiliary apparatus, provided corresponding to each receiving chamber, for sending the coil springs having different wire diameters when the opening/closing sections of the coil chute are open.

3. An apparatus for producing a pocket coil bag row as stated in claim 2, further comprising:

a feeding apparatus for adjusting feeding speed of a cloth sheet depending on the type of the coil springs inserted into the cloth sheet.

4. An apparatus for producing a pocket coil bag row as stated claim 2, further comprising:

a metal sensor for determining whether or not the coil springs having different wire diameters inserted into a folded cloth sheet are inserted.

5. An apparatus for producing a pocket coil bag row as stated in claim 4, further comprising:

a feeding apparatus for adjusting feeding speed of the cloth sheet depending on the type of the coil springs inserted into the cloth sheet.

6. An apparatus for producing a pocket coil bag row as stated in claim 4, further comprising:

a marking apparatus for marking the cloth sheet to identify the type of the coil springs to be enclosed in the bag.

7. An apparatus for producing a pocket coil bag row as stated in claim 2, further comprising:

heat treatment apparatuses for heat treating the coil springs having electrodes provided at both sides of any area of the conveying apparatus for conveying the coil springs having different wire diameters to the coil chute section.

8. An apparatus for producing a pocket coil bag row as stated claim 7, further comprising:

a metal sensor for determining whether or not the coil springs having different wire diameters inserted into a folded cloth sheet are inserted.

9. An apparatus for producing a pocket coil bag row as stated in claim 8, further comprising:

a marking apparatus for marking the cloth sheet to identify the type of the coil springs to be enclosed in the bag.

10. An apparatus for producing a pocket coil bag row as stated in claim 7, further comprising:

a marking apparatus for marking the cloth sheet to identify the type of the coil springs to be enclosed in the bag.

11. An apparatus for producing a pocket coil bag row as stated in claim 7, further comprising:

a feeding apparatus for adjusting feeding speed of a cloth sheet depending on the type of the coil springs inserted into the cloth sheet.

12. An apparatus for producing a pocket coil bag row as stated in claim 1, further comprising:

heat treatment apparatuses for heat treating the coil springs having electrodes provided at both sides of any area of the conveying apparatus for conveying the coil springs having different wire diameters to the coil chute section.

13. An apparatus for producing a pocket coil bag row as stated in claim 12, further comprising:

a metal sensor for determining whether or not the coil springs having different wire diameters inserted into a folded cloth sheet are inserted.

14. An apparatus for producing a pocket coil bag row as stated claim 13, further comprising:

a feeding apparatus for adjusting feeding speed of the cloth sheet depending on the type of the coil springs inserted into the cloth sheet.

15. An apparatus for producing a pocket coil bag row as stated in claim 12, further comprising:

a marking apparatus for marking the cloth sheet to identify the type of the coil springs to be enclosed in the bag.

16. An apparatus for producing a pocket coil bag row as stated in claim 12, further comprising:

a feeding apparatus for adjusting feeding speed of the cloth sheet depending on the type of the coil springs inserted into the cloth sheet.

17. An apparatus for producing a pocket coil bag row as stated claim 1, further comprising:

a metal sensor for determining whether or not the coil springs having different wire diameters inserted into a folded cloth sheet are inserted.

18. An apparatus for producing a pocket coil bag row as stated in claim 17, further comprising:

a feeding apparatus for adjusting feeding speed of the cloth sheet depending on the type of the coil springs inserted into the cloth sheet.

19. An apparatus for producing a pocket coil bag row as stated in claim 1, further comprising:

a feeding apparatus for adjusting feeding speed of a cloth sheet depending on the type of the coil springs inserted into the cloth sheet.

* * * * *